United States Patent [19]

Beretta

[11] 4,271,623

[45] Jun. 9, 1981

[54] PISTOL WITH STOCK EXTENSION AND AUXILIARY GRIP

[75] Inventor: Pier C. Beretta, Gardone V.T., Italy

[73] Assignee: Fabbrica d'Armi P. Beretta S.p.A., Gardone V.T., Italy

[21] Appl. No.: 7,431

[22] Filed: Jan. 29, 1979

[30] Foreign Application Priority Data

Feb. 10, 1978 [IT] Italy ..... 6920/78[U]
Feb. 10, 1978 [IT] Italy ..... 5128 A/78

[51] Int. Cl.[3] ..... F41C 23/00
[52] U.S. Cl. ..... 42/72; 42/71 P; 42/73
[58] Field of Search ..... 42/72, 71 R, 71 P, 73

[56] References Cited

U.S. PATENT DOCUMENTS 3,803,976 4/1974 Visser ..... 42/72
3,906,833 9/1975 Orozco ..... 42/72

*Primary Examiner*—Donald P. Walsh

[57] ABSTRACT

The present invention comprises a crown for enclosing therein the firing mechanism of a pistol having a stock and a hand guard for protecting the trigger. The pistol is characterized by the fact that to the stock there is removably attached an extension rod which extends in two sections in a direction opposed to that of the barrel. The extension rod has a T-shaped extremity. The hand guard for the trigger has pivoted thereon a lever urged by a small spring-loaded piston to become blocked either in a first active position that is downwardly inclined with respect to the crown of the pistol, or in a second inactive or rest position through the displacement of the lever toward and near the crown itself.

7 Claims, 8 Drawing Figures

PISTOL WITH STOCK EXTENSION AND AUXILIARY GRIP

BACKGROUND OF THE INVENTION

1. Field of the Invention

The present invention relates to pistols in general and, more particularly, to stock extension means and an auxiliary grip applicable to pistols such as automatic pistols, for example.

2. Description of the Prior Art

Devices are already known for application to machine pistols and the like, to serve as a stock or a butt therefor and to improve their grip and their handling during their use, the devices being removable from the weapon after use. The famous British Sten gun of World War II is a typical example.

However, auxiliary and supplementary gripping means for pistols have heretofore never been suggested and it is, therefore, the main object of the present invention to furnish a pistol with gripping and handling means which permit a safer and more comfortable handling of the weapon and a far more accurate firing.

It is another object of the present invention to provide a pistol supplied with an extension rod for its stock, the rod being capable of placement against the user's shoulder and being detachable from the weapon, as well as foldable on the stock after use.

It is a further object of the present invention to provide a pistol with a supplementary handle coordinated with the shape of the hand guard and capable of being grasped by the user's hand that is opposed to the one used in squeezing the trigger, the supplementary handle being snap-positionable in both active and inactive positions.

It is still another object of the present invention to provide a pistol with a grasping means and with an auxiliary handle means, employable either concurrently or separately from each other.

SUMMARY OF THE INVENTION

These and other objects are achieved by the pistol of the present invention, which briefly stated, comprises a crown for enclosing therein the firing mechanism and having a stock or handle and a hand guard for protecting the trigger. The weapon is characterized by an extension rod that is removably attached to the stock with the extension rod being formed in two half portions in a direction opposed to that of the barrel. The extension rod as a T-shaped extremity. The hand guard for the trigger has a lever pivoted thereon urged by a small spring-loaded piston to become blocked into a first active position that is downwardly inclined with respect to the crown of the pistol, or into a second inactive or rest position through the displacement of the lever toward and near the crown itself.

BRIEF DESCRIPTION OF THE DRAWING

Further details of the invention will become apparent from the following description thereof, with reference to the illustrative embodiment shown in the accompanying drawings, in which.

DESCRIPTION OF THE PREFERRED EMBODIMENT

Figure 3:
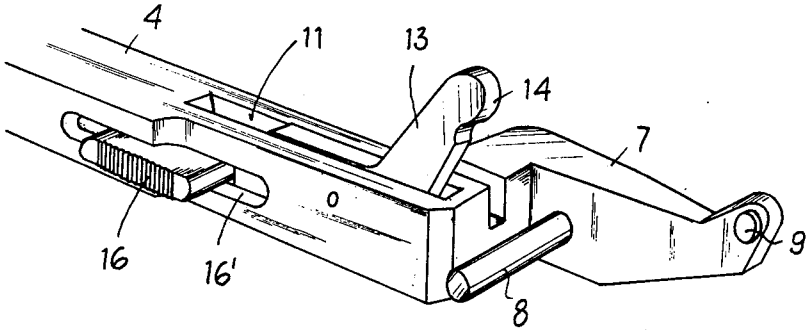
FIG. 3 is a enlarged perspective view of the means for attaching the rod of the stock.
Figure 2:
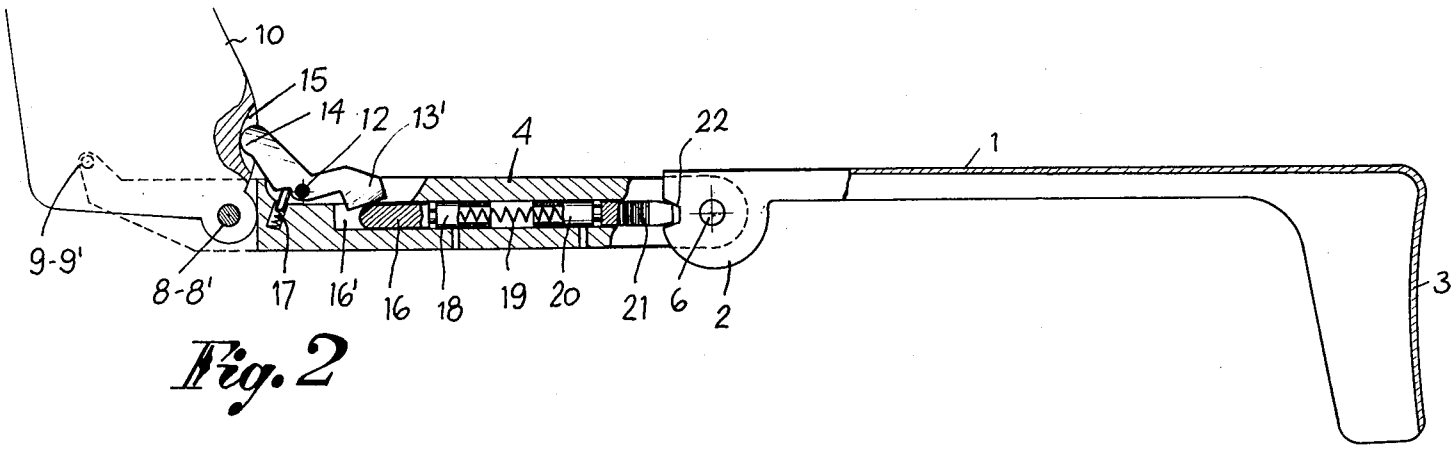
FIG. 2 is a partial, longitudinal sectional elevational view of the extension rod of this invention applied to the stock.

Referring now to the drawings, the stock 10 of the pistol, which carries a crown I enclosing a firing mechanism that is so well known that there is no need to define it in greater detail, and a hand guard G for protection of a trigger T, is attached to an extension which comprises a first rod-like element 1 which has a bifurcated extremity limited by a pair of laterally spaced apart wings 2 of semicircular profile. The other extremity of the rod-like element 1 is provided with a T-shaped base 3 which is adapted to rest against the shoulder of the user. The extension further comprises a second rod-like element 4 of which one extremity 5 is pivotally mounted on a transverse pin 6 to the two wings 2 of the first rod-like element 1, while the other extremity 7 of rod-like element 4, preferably displaced laterally with respect to the plane of the two rod-like elements 1 and 4, is provided, as shown in FIGS. 2 and 3, with two pins 8 and 9 that are spaced from each other and which engage corresponding holes or seats 8'–9' made in the stock of the pistol. On the second rodlike element 4 is pivoted, within a suitable slit 11 and by means of a transverse pin 12, a rocking L-shaped lever 13, the arm of which extends above the rod-like element 4 and is provided with a frontal hook 14 which serves to engage a slotted recess 15 appropriately provided in the stock of the pistol. The other arm 13', that is the horizontal one of the lever 13, extends towards a sliding bolt 16 guided in a transverse seat or slit 16' which is provided in the rod-like element 4. The rocking lever 13 is engaged by a compression spring 17 which always keeps it displaced in a rest position to which corresponds the disengagement of the front hook 14 from the recess 15 of the grip or handle of the weapon.

In turn, the sliding bolt 16 engages a small piston 18 that is urged by an expansion spring 19 which acts in the direction of always maintaining the bolt 16 displaced toward the rocking lever 13.

The expansion ring 19, besides urging the piston 18 to push the bolt 16, also acts against a second piston 20 that is aligned with the first piston 18 and acting, in turn against a second blocking bolt 21 which is itself guided in a slit 21' provided in the rod-like element 4 and arranged to engage within radial notches or seats 22, suitably provided on the two wings 2 of the first rod-like element 1. Finally, the small pistons 18 and 20 are of such a length as to rest one against the other when their respective bolts 16 and 21 are both displaced backward in a rest position.

Figure 1:
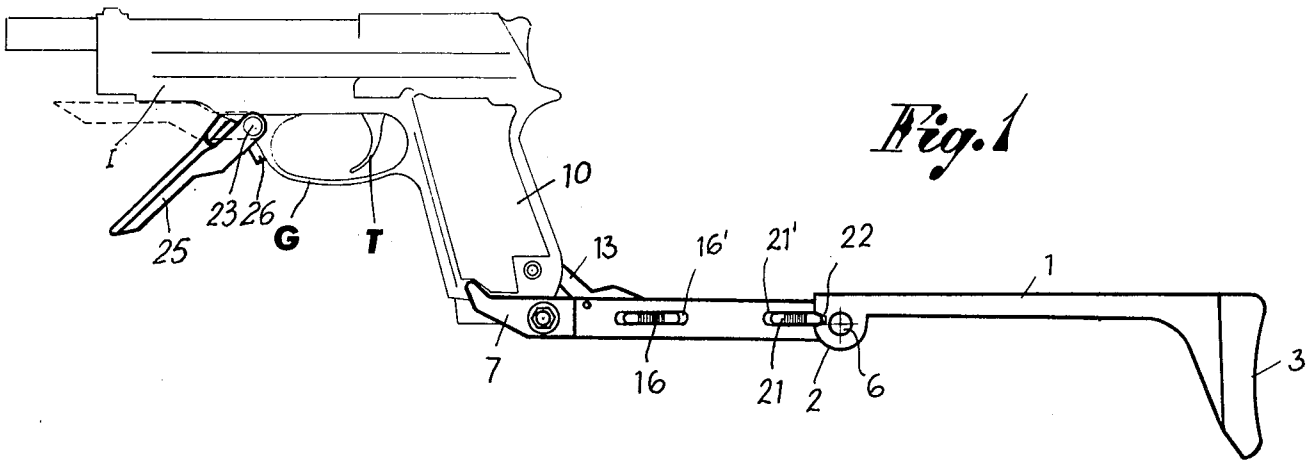
FIG. 1 is a view of a pistol complete with a stock extension and with an auxiliary handle comprising the present invention.

In order to use the above-described extension, the two rod-like elements 1 and 4 are aligned with each other and blocked in this position by means of the bolt 21 in the notches or seats 22 radially provided in the wings 2 of the rod-like element 1 (see FIGS. 1 and 2).

The application of the stock support is obtained by placing the pins 8 and 9 in their respective holes or seats 8' and 9' and by manually moving the rocking lever 13 so that its front hook 14 engages in the corresponding recess 15 of the handle. The blocking of the rocking lever 13 in position of engagement is insured by the bolt 16, which, upon displacement caused by its respective piston 18, is inserted beneath the arm 13' of the rocking lever 13, thus keeping the rocking lever near the handle of the weapon.

To detach the stock support from the pistol, it is sufficient to move the bolt 16 so that the rocking lever 13, which is urged by its spring 17, is displaced angularly and brings its front hook 14 outside of the recess 15 of the handle of the pistol.

Figure 4:
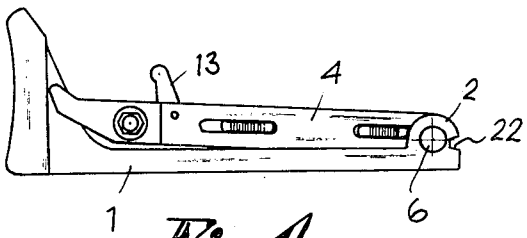
FIG. 4 is a side elevational view illustrating the extension rod of the present invention in folded position after use.

Finally, to fold the support, so as to reduce the volume thereof, it suffices to displace and disengage the bolt 21 from the notches 22 of the wings 2 of the first rod-like element 1. In this manner, the two rod-like elements 1 and 4 can be reciprocally moved towards each other so as to move them angularly about the pin 6, while the bolt 21 is kept in the backing position by means of the action effected by the two wings 2 (see FIG. 4).

Figure 5:
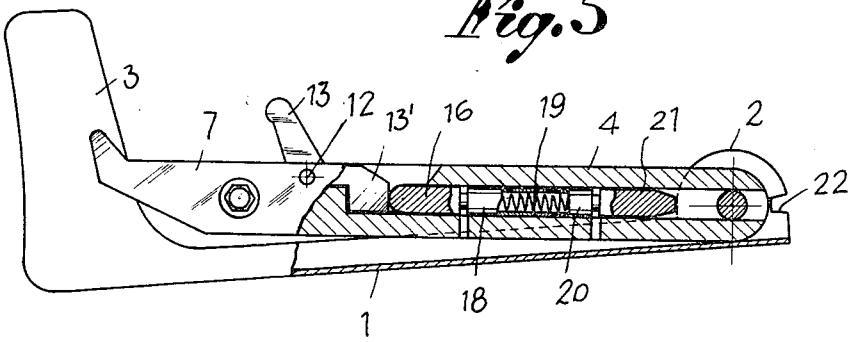
FIG. 5 is an enlarged, partial longitudinal sectional view, in elevation of the folded rod of the present invention.

When the stock support is folded, the two bolts 16 and 21 are displaced, one toward the other and their respective pistons 18 and 20 are brought close to each other so as to rest one against the other (see FIG. 5). In these conditions, the bolt 16 is axially blocked and prevents the angular displacements of the rocking lever 13 which is thus blocked in its rest position and, consequently, in a position to permit a successive and immediate application of the stock support without need of insuring the functioning of the engaging lever.

Figure 6:
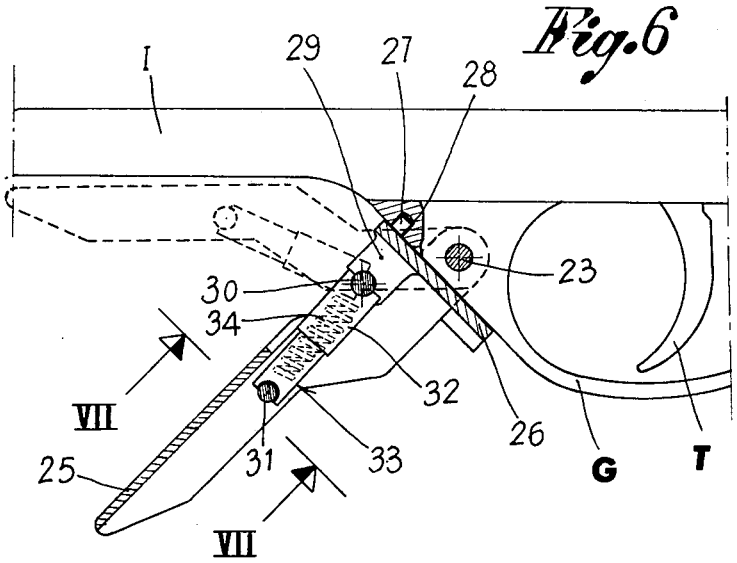
FIG. 6 is a fragmentary elevational view illustrating the means for the mounting of the auxiliary handle comprising the present invention on the hand guard.
Figure 8:
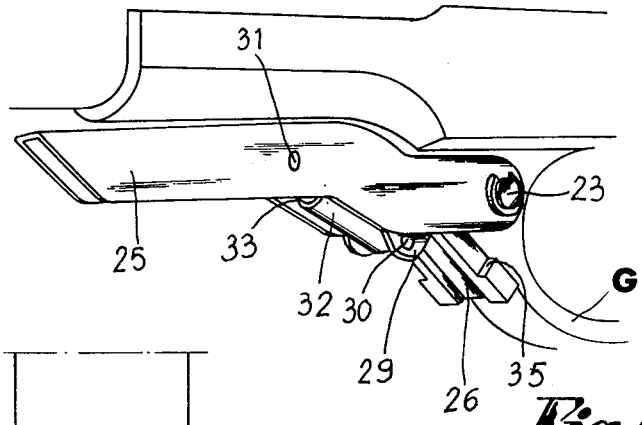
FIG. 8 is a perspective view of the auxiliary handle of the present invention positioned in the vicinity of the crown of the pistol.
Figure 7:
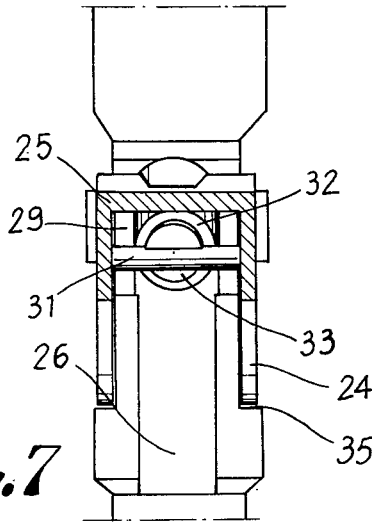
FIG. 7 is an enlarged transverse sectional elevational view taken along line VII—VII of FIG. 6.

Still, according to the invention, on the hand guard G of the pistol is pivoted, by means of a transverse pin 23, the bifurcated extremity 24 of a lever 25 which forms an auxiliary handle (see FIGS. 6–8).

Between the two arms of the bifurcated element 24 there is a small support 26 which has a pin 27 that sits in a corresponding hole 28 provided in the front part of the handguard. The support 26 is blocked against the handguard G of the weapon and has two ears 29, between which a pin 30 is attached.

Also in the intermediate portion of the lever 25 there is a transverse pin 31, and between this pin 31 and the pin 30 of the small support 26 there is mounted an extendible piston comprising two telescopic, tubular members 32 and 33, enclosing therein a compression spring 34. The opposite extremities of the two tubular members 32 have a slit which is articulated and guided on the pair of corresponding pins 30, 31. Finally, the support 26 has two lateral shoulders 35, one on each side, on which rest the lateral arms of the bifurcated element 24 to determine the position of the employment of the handle.

The extendible piston 32 and 33 with the spring 34 determines by itself on one hand the blockage of the support 26 against the handguard G, and on the other hand, the blockage of the lever 25, either in use position or in the rest position near the crown I of the pistol.

To this effect, as shown particularly in FIG. 6, the pins 30, 31 of the extendible piston 32 and 33 and the pin 23 of the lever 25 are positioned so that they are in non-alignment with each other both when the lever 25 is in a use position and when it is in a rest position. In this manner, it suffices to move the lever 25 angularly until it overcomes the deadspot of greatest compression of the piston, so that the lever 25 trips, upon urging of the spring 34, in the use position defined by the shoulders 35 of the support 26 or in the rest position near the crown of the pistol.

I claim:

1. In a pistol including a body portion having a barrel, a stock and a handguard for protection of the trigger, the improvement comprising the combination of an elongated, foldable extension removably attached at one end thereof to the stock and extending in a direction opposite to that of the barrel of the pistol with the opposite end of said extension being T-shaped and an auxiliary handle lever pivotally coupled to the handguard, there being further included that is urged by an extendible spring biased piston for locking said auxiliary lever in a first position that is inclined downwardly with respect to said body portion, and in a second position that is substantially parallel and close to said body portion.

2. The improvement according to claim 1, wherein said extension is comprised of first and second rod-like elements to an approached position; means for locking said two rod-like elements in a position of mutual alignment; and means provided at the end of one of said elements for engagement with complementary means provided on the stock of the pistol.

3. The improvement according to claim 2, wherein said first rod-like element has a forked end defined by two wings between which there is provided and pivoted the adjacent end of said second rod-like element, said wings having two radial notches, in which is engaged a first blocking bolt mounted and guided on said second rod-like element; said first bolt being urged by a first spring-loaded piston so as to always abut said wings.

4. The improvement according to claim 3, wherein to the free end of said second rod-like element there are fixed two pins arranged to engage in corresponding seats provided in the stock; adjacently to said pins there being mounted a rocking lever having an end facing upwardly and provided with a front hook arranged to engage a corresponding recess provided on the handle of the pistol; said rocking lever being urged by a spring adapted to keep it in a rest position; to said rocking lever being associated a second blocking bolt mounted on said second rod-like element and cooperating with said blockage lever in the use position of engagement; said second blocking bolt being urged by a second spring-loaded piston 18 for always adhering to said rocking lever.

5. The improvement according to claim 4, wherein said first and second bolts are facing and act in opposite directions from each other and said respective first and second pistons are urged by a common spring interposed therebetween; the length of said first and second pistons being such as to have one resting against the other when both said first and second bolts are in a back position and said first and second rod-like elements are near each other.

6. The improvement according to claim 1 wherein said lever handle comprises a forked end having two laterally spaced apart arms on the handguard of the pistol; a support positioned between said two arms of said fork and blocked against the front part of the handguard; and an extendible piston mounted on and engaged between two pins attached to said support and respectively, in the intermediate part of said lever element, said support having two lateral shoulders on which rest said two arms of said fork for the blockage of said lever element in a use position.

7. The improvement according to claim 6, wherein said extendible spring-loaded piston has slits at the opposed extremities thereof, which extremities are articulated on said pins of said support and, respectively, of the lever element; said pins and the pivot of said lever element being so positioned as to be in non-alignment when said lever element rests against said shoulders in the use position of the handle.

* * * * *